United States Patent [19]

Piggott

[11] Patent Number: 4,568,322

[45] Date of Patent: Feb. 4, 1986

[54] PLASTIC BAG MACHINE HAVING A SEPARATING APPARATUS

[75] Inventor: David C. Piggott, Burlington, Canada

[73] Assignee: PCL Packaging Limited, Oakville, Canada

[21] Appl. No.: 577,715

[22] Filed: Feb. 7, 1984

[30] Foreign Application Priority Data

Dec. 16, 1983 [CA] Canada ..... 443472

[51] Int. Cl.[4] ..... B31B 1/86; B31B 23/14; B31B 27/14

[52] U.S. Cl. ..... 493/461; 493/196; 493/926

[58] Field of Search ..... 493/194, 195, 196, 198, 493/199, 201, 204, 230, 234, 238, 239, 302, 363, 372, 472, 926, 461

[56] References Cited

U.S. PATENT DOCUMENTS

| | | | |
|---|---|---|---|
| 2,768,560 | 11/1956 | Hirson | 493/372 |
| 2,942,529 | 6/1960 | Piazze | 493/196 |
| 3,071,046 | 1/1963 | Conant | 493/372 |
| 3,599,538 | 8/1971 | Piazze | 493/194 |
| 4,131,503 | 12/1978 | Plate | 493/194 |
| 4,164,170 | 8/1979 | Nordin | 493/194 |
| 4,368,051 | 1/1983 | Lehmacher | 493/11 |
| 4,462,857 | 7/1984 | Mundus et al. | 156/361 |

FOREIGN PATENT DOCUMENTS

| | | | |
|---|---|---|---|
| 1068239 | 12/1979 | Canada | 493/239 |

*Primary Examiner*—Francis S. Husar
*Assistant Examiner*—William E. Terrell
*Attorney, Agent, or Firm*—Wegner & Bretschneider

[57] ABSTRACT

There is disclosed a bag making machine for producing wave top bags from an elongate strip of plastic web material. The disclosure relates to various improvements in the bag making machine such as the apparatus for spreading cut web material in directions transverse to the direction of elongation of web material.

5 Claims, 13 Drawing Figures

CYLINDER

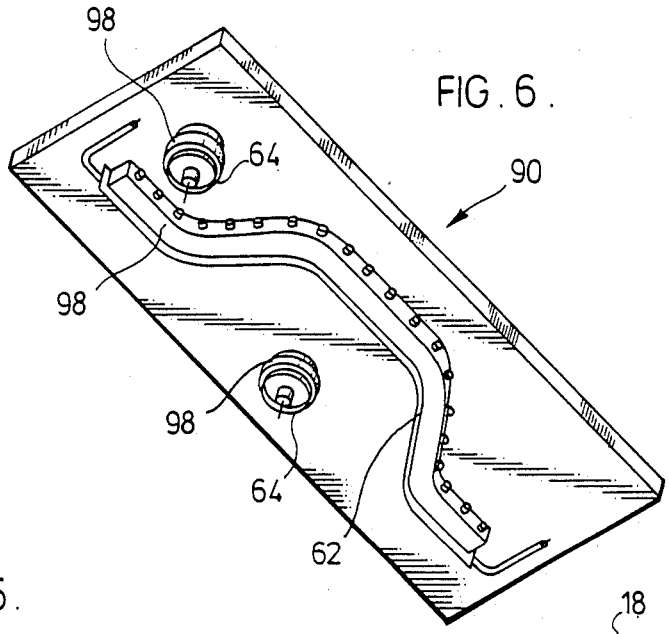
FIG. 6.
FIG. 5.
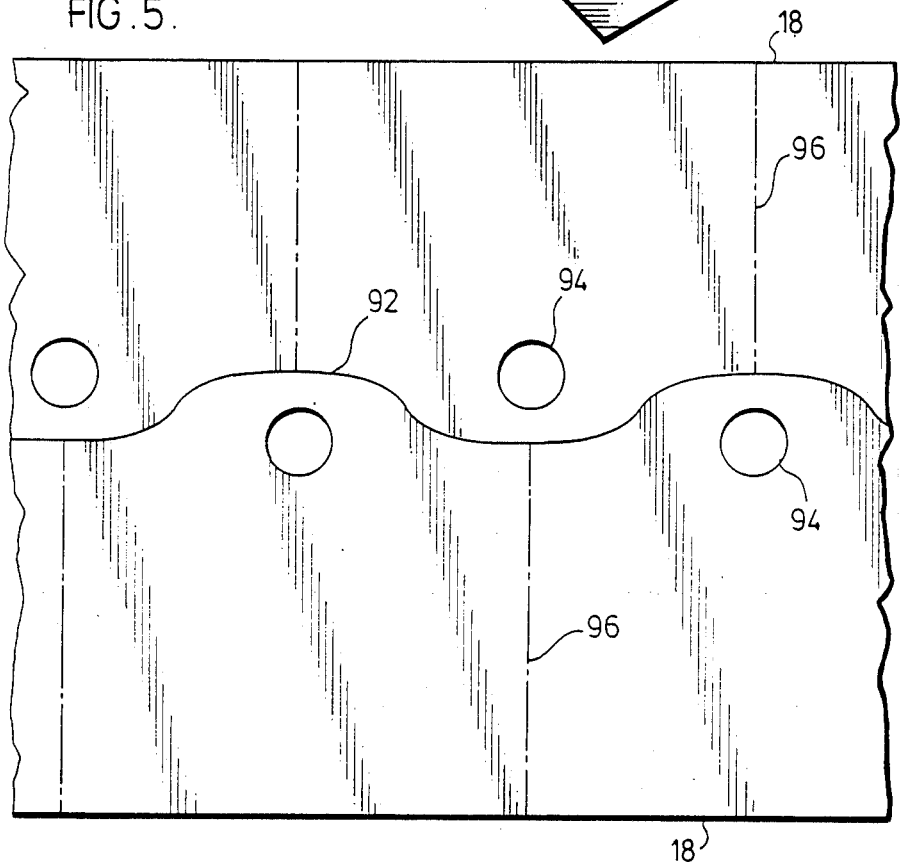

58
FIG. 7.
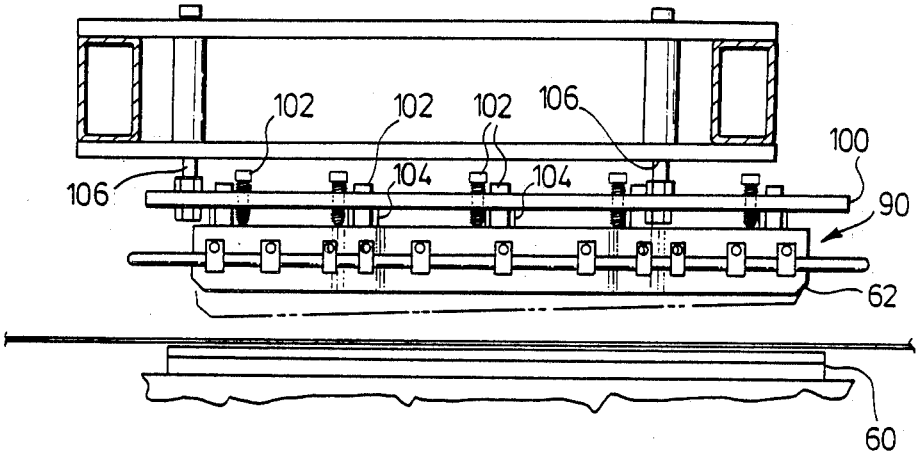
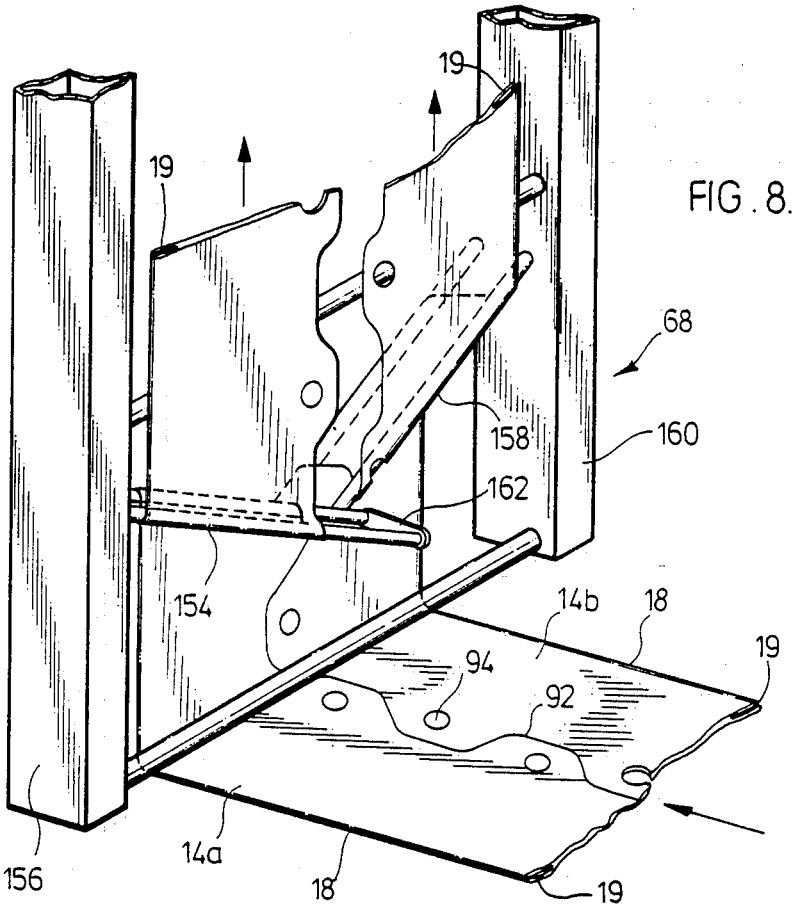
FIG. 8.

FIG. 11.
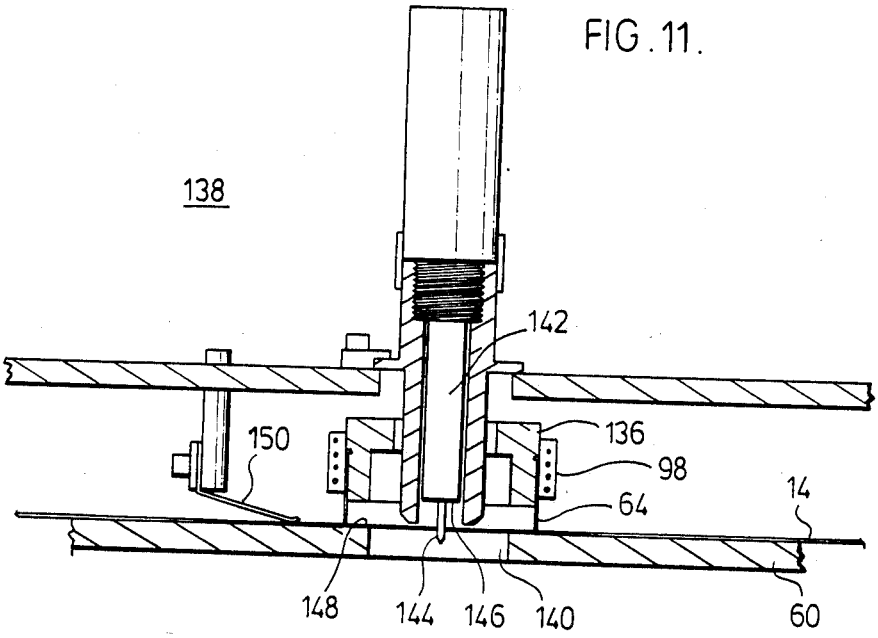
FIG. 12.
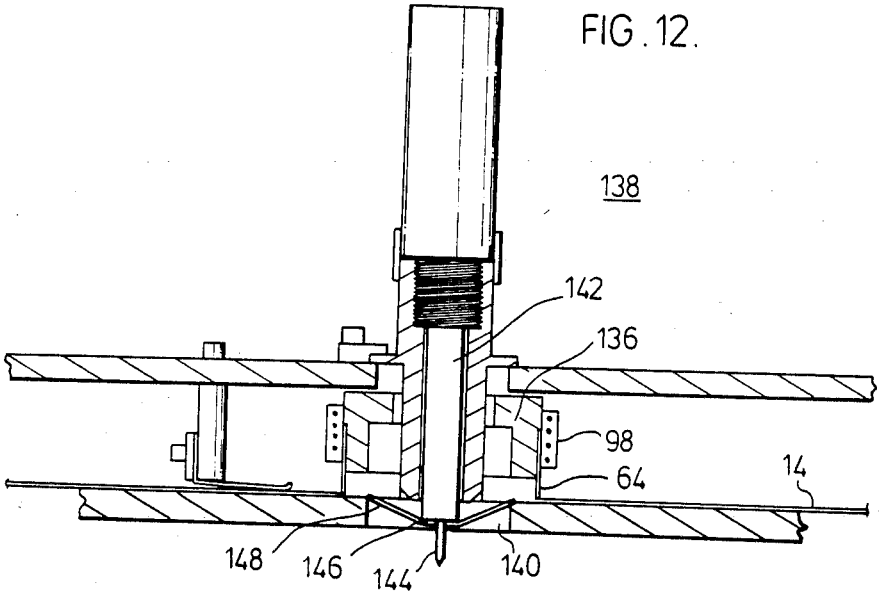
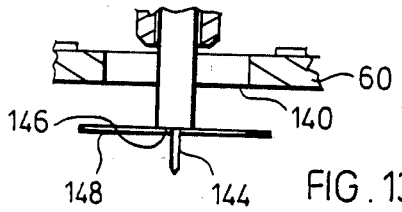
FIG. 13.

PLASTIC BAG MACHINE HAVING A SEPARATING APPARATUS

The present invention relates to a bag making machine and more particularly relates to an improved machine for fabricating wave top bags from plastic material in the form of an elongate tubular web.

It is known to form bags from tubular feed stock of thermoplastic web material wherein the tubular stock is flattened such that side edge creases or gussets are formed which define the bottom of the bag. This web material is fed into the bag machine where it is cut generally longitudinally to form the bag handles. The bag machine subsequently cuts and seals the plastic web transversely to the direction of the tube elongation to form the sides of the bag.

A disadvantage associated with bag making machines is that the plastic bags are interleaved when stacked at the end of the operation. While it is known to phase the two web portions once the web has been cut, the web portions still overlap. In particular the handles overlap and during stacking of the formed bags, the handle portions interleave and must be manually separated. This reduces the efficiency. While it may be known that separating the bags will solve this problem, heretofore no apparatus has been available to accomplish separation.

It is therefore an object of the present invention to provide a more efficient bag making machine.

It is another object of the present invention to provide a bag making machine which allows for the spreading of two web portions cut from the single web portion such that the bags are not stacked in an interleaved fashion.

In accordance with an aspect of the present invention there is provided a bag making machine for producing bags from an elongate strip of plastic web material including means for cutting the web material into first and second elongate web portions and including means to separate the web portions in a direction transverse to the direction of elongation of the web material. The separating means comprises at least a first pair of parallel rods inclined at a first angle normal to the direction of elongation of the first web portion. The first web portion travels around a first rod of the first rod pair to alter its direction of web travel to include a component transverse to the direction of elongation of the first web portion and away from the second web portion. The first web portion travels around the second rod of the first rod pair to again alter the direction of web travel by eliminating the transverse component from the direction of travel.

The bag making machine may include a second pair of parallel rods inclined at a second angle normal to the direction of elongation of said second web portion. The second web portion travels around a first rod of the second rod pair to alter its direction of web travel to include a component transverse to the direction of elongation of the first web portion and away from the first web portion. The second web portion travels around the second rod of the second rod pair to again alter the direction of web travel by eliminating said transverse component from the direction of travel.

In the preferred construction of the machine, the first rod of each rod pair lies below and forward of the second rod of each rod pair. The first and second web portions travel over the first rod and under the second rod of each respective rod pair. The first rod pair is preferably offset from the second rod pair. The first rod pair is off-set horizontally and vertically from the second rod pair and the first and second web portions travel in generally vertical directions prior and subsequent to the rod pairs. The rods preferably do not rotate. The machine preferably includes two horizontal rollers displaced vertically from one another one half bag width apart. The first and second web portions travel over respective horizontal rollers subsequent to separation so as to be shifted in phase relative to each other.

By allowing the two web portions to be separated and phased prior to the cutting and sealing of the sides of the bags, the bag handles do not overlap and as a result are stacked in separate groups.

The preferred construction of the bag making machine includes front web driving means located forward of said cutting means, and rear web driving means located rearward of the cutting means. The front and rear web driving means are intermittently operable when the cutting means is non-operable to advance the web material from the rear web driving means toward the front web driving means. The rear web driving means includes adjustment means for varying the driving force of the rear web driving means whereby web tension between the front and rear web driving means is controlled.

In the preferred construction of the bag making machine the cutting means comprises stationary cutting means arranged in a predetermined pattern to cut the bag handles. The apparatus further includes movable support means over which the web material travels. The movable support means is movable between a first position separated from the cutting means and a second position forcing the web material into cutting engagement with the cutting means. The apparatus includes reciprocally movable drive means for effecting intermittent movement of the movable support means between its first and second positions and coupling means interconnecting the drive means and the support means to translate reciprocating movement of the drive means into movement of the support means.

The stationary cutting means preferably includes a curved blade means for cutting the peripheries of the bag handle and two circular blade means, one on either side of the curved blade means. Each circular cutting blade means includes a cutting blade shaped to cut a coupon from the web material to form the bag handle aperture to a first predetermined size. The circular cutting means includes a plunger within the cutting periphery of the circular cutting means. The plunger is movable relative to the circular cutting means. The plunger includes piercing means on a leading face thereof. The support means has one aperture for each of the circular cutting means; the aperture being located in alignment with the plunger. The support means aperture is greater in size than the plunger and less in size than the first predetermined size. The support means and cutting means are movable relative to one another to bring the web material into engagement with the cutting means whereby the coupon is cut from the web material. The piercing means pierces the web material and extends into the support means aperture to positively hold the web material proximate the cutting periphery as the coupon is cut. The circular cutting means includes means for actuating movement of the plunger into the support means aperture when the coupon is cut so as to eject the coupon from the web material upon withdrawal of the plunger from the support means aperture.

For a better understanding of the nature and objects of the present invention reference may be had by way of example to the accompanying diagrammatic drawings in which:

FIG. 5 is a view showing the manner in which the plastic web is cut generally longitudinally by the bag cutting apparatus;

FIG. 6 is a bottom three dimensional view of the cutting means of the bag handle cutting apparatus;

FIG. 7 is a side view of the upper portion of the bag handle cutting apparatus;

FIG. 8 is a three dimensional view showing the separating apparatus of the present invention;

FIGS. 10, 11 and 12 are side sectional views showing the operation of the apparatus for cutting the bag handle holes; and, FIG. 13 is a partial side sectional view of the plunger apparatus of the circular cutting apparatus.

Figures 1, 2:
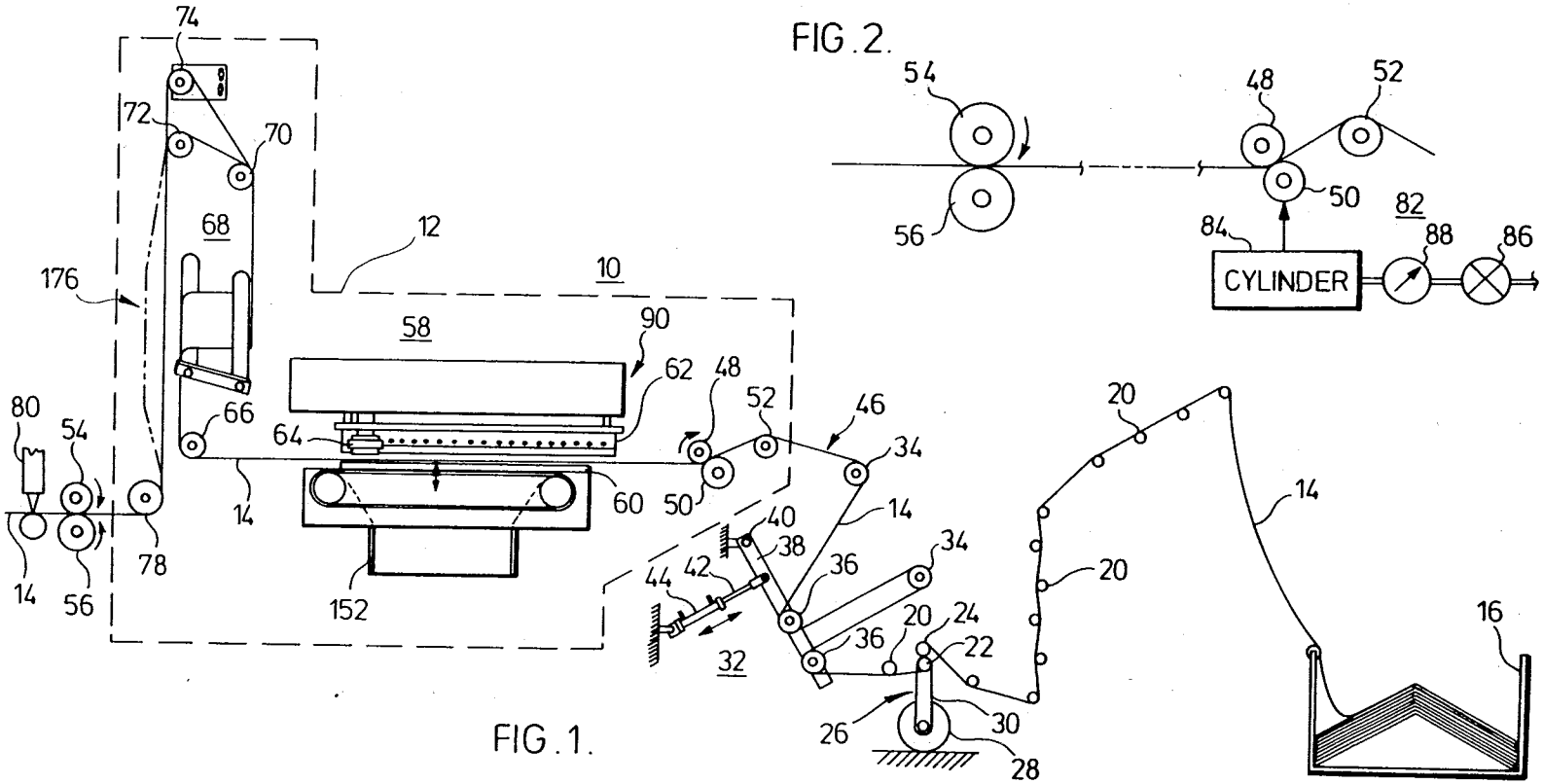
FIG. 1 is a schematic representation of a bag making machine.
FIG. 2 is a partial schematic view showing the relationship between the driving rollers of the bag machine.

Referring now to FIG. 1 there is shown schematically a bag making machine 10 of the present invention. The improvements in the bag making machine are, for the most part, contained within dotted lines 12. The remainder of the machine is similar to that shown and described in Canadian Pat. No. 947,556 issued May 21, 1974 to G. G. Plate.

An elongate web material 14 is drawn from a bin 16. Web material 14 comprises a flattened tubular thermoplastic web material having gussets 19 (see FIG. 8) formed where the web material is flattened along its outside edge 18 parallel to the direction of elongation of the material. The outside edges 18 form the base of the plastic bag yet to be manufactured by bag making machine 10. The web 14 is drawn through idler rollers 20 by drive roller 22 of the capstan nip rollers 22 and 24. The web material wraps about the drive roller 22 to minimize slippage of the web material thereon. The drive roller 22 forms part of a capstan drive 24 which comprises a drive motor 28 operatively connected to a rubber covered drive roller 22 by means of a chain or pulley 30. The web material is then fed through a compensator generally shown at 32. The compensator comprises a plurality of idler rollers 34 journaled for rotation in a fixed position and a plurality of idler rollers 36 supported by a bar 38. Bar 38 is pivotally secured at 40 and pivotally secured to piston rod 42. While the piston rod is shown, it should be understood that a spring could also be used. The bar 38 is designed to pivot about point 40 so as to allow for a predetermined range of tensions to be applied to the web material as it travels through the bag making machine. As a result, the piston 44 maintains a constant uniform pressure on arm or bar 38 regardless of the relative position of bar 38. The travel of the bar 38 is sensed by appropriate sensing means and when the travel of the bar extends beyond a predetermined displacement in either direction, the angular velocity of motor 28 is altered accordingly so as to return the bar 38 to within its range of movement and thereby maintain a predetermined range of tensions on the web material at position 46 of the web travel path through the bag making machine.

The web material 14 passes about rear nip web driving rollers which have been referred to previously as rear web driving means. The rear web driving means comprise a rear driving roller 48, a rear nip idler roller 50 abutting roller 48, and an idler roller 52 which controls the angle of wrap about roller 48. Roller 48 is intermittently operated in conjunction with intermittent operation of front drive roller 54 shown towards the left in the drawing. Front drive roller 54 abuts idler roller 56 and acts to draw the web through the bag cutting apparatus. Rollers 54, 56 have been previously referred to as the front web driving means. The relationship of drive roller 48 and drive roller 54 is better shown in FIG. 2 and shall be described in more detail after a further discussion of the bag operating machine. As the web is intermittently driven past rear drive roller 48, it is driven between the bag handle cutting apparatus 58 of the bag machine 10. The cutting apparatus 58 cuts the handles from the bag by cutting the circular handle apertures and by cutting the web in a longitudinally extending wave form to provide the bag handle peripheries. The cutting of the bag handle peripheries and apertures is achieved simultaneously by moving support means or lower plate 60 into cutting engagement with the cutting means or cutting blade 62 and circular cutting apparatus 64.

After the web is cut, the web passes in two portions past idler pulley or roller 66 and over a web spreading means or apparatus generally shown at 68. This apparatus causes the two web portions to spread apart. One of the two web portions then passes over idler rollers 70 and 72 while the other web portion passes over idler rollers 70 and 74 to effect a phase shift such that the handles of the bag are brought into alignment. The handles of the bag may then be folded at station 76 prior to the web portions passing about drive assist roller 78 and through the drive rollers or draw rollers 54, 56. Subsequent to this a cutting and sealing bar 80 cuts the bag or web portion transversely of the direction of elongation of the web material so as to cut the side edges of the bag. The sealing bar seals the side edges.

Referring now to FIGS. 1 and 2, the rear web driving means is shown to comprise, in addition to rear drive nip rollers 48, 50 and idler rollers 52, an adjustment means 82. The adjustment means comprises a cylinder 84 operably connected to the idler roller 50 of the rear nip rollers. In practice, two cylinders are connected to opposing spindle ends of the idler roller 50. The purpose of the cylinder 84 is to move roller 50 into pressure or nipping engagement with rear nip drive roller 48. The cylinders 84 are pressured by a suitable fluid, such as air for example. A valve 86 is provided to control fluid pressure to the piston and a pressure gauge 88 permits the operator to monitor the pressure. By controlling the pressure of the rear nip drive rollers 48, 50, their driving force is regulated. In practice, slippage between rollers 48, 50 is in the order of 4 to 5%; however, web slippage can be reduced or controlled by using the adjustment means to increase the nip pressure. As a result, the amount of web material drawn between rollers 48, 50 is controlled. The rear nip rollers 48, 50 are of a slightly larger diameter than the front nip rollers 54, 56 and the rear rollers 48, 50 are geared to rotate such that their peripheral speed is slightly greater than that of front rollers 54, 56. It is, however, the amount of slippage between rollers 48, 50 that controls the amount of web drawn by rear nip rollers 48, 50. In this regard, the valve 86 of the adjustment means 82 is usually set by the machine operator such that during each cycle of operation the rear nip rollers 48, 50 draw slightly more web material therethrough than the front nip rollers 54, 56. The web driving rollers 48, 50 comprise a pair of rubber covered nip rollers around which the web material is partially wrapped due to the position of idler roller 52.

Rollers 66, 70, 72 and 74 are rotated when the web is driven or fed through the machine on an intermittent basis. When the front drive rollers 54, 56 stop driving the web, the rollers 66, 70, 72 and 74, have a momentum associated with each roller which causes them to slip relative to the web material. In the present invention, the driving rollers 48, 50 act as a brake preventing the web from stretching further due to the rollers temporarily continuing to rotate. Further, because the rollers 48, 50 and 54, 56 positively hold the web material in a controlled position therebetween and isolated from compensator 32, the web material does not tend to float resulting in a more accurate, quicker cut by the cutting means 58.

Referring now to FIGS. 3 through 7 the cutting means 58 is described. Referring in particular to FIG. 7 the cutting means is shown to comprise a stationary cutting means 90 having a cutting blade 62 of predetermined curvature to cut the periphery of the bag handles and two circular cutting blades 64 (see FIG. 6) disposed on opposing sides of the cutting blade 62 for cutting the bag handle apertures from the plastic web material. The cutting means 58 further comprises a movable support means or plate 60 which is movable relative to the stationary cutting means 90 to bring the plastic web material 14 into cutting engagement with the blades 62 and 64. Referring to FIG. 5 the pattern cut from the web material is shown to comprise a longitudinally extending gently curved wave form 92 and circular apertures 94. The broken lines 96 indicate those areas along which the bags must be cut and sealed by the sealing and cutting bar 80 at a later sequence in the operation.

Each of the blades 62 and 64 are provided with a heater element 98 attached thereto. The purpose of heater element 98 is to enhance the cutting ability of the cutting blades.

The cutting blade is attached to a mounting plate 100 by means of push pull bolts 102 and spacers 104. The purpose of the push pull bolts is to provide for fine adjustment of the cutting blades 62, 64 relative to the lower suppot means or support plate 78. Bolts 106 provide for gross adjustment of cutting blades.

Figure 4:
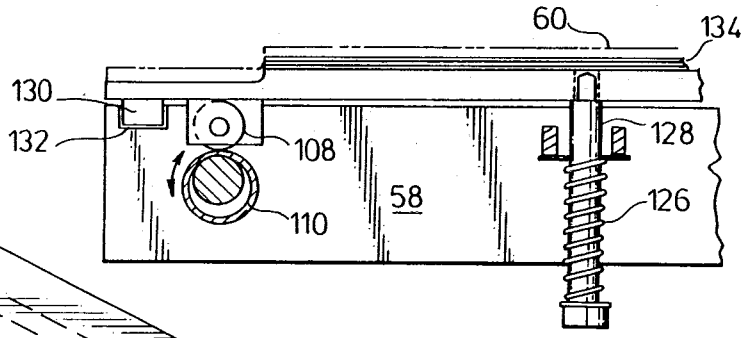
FIG. 4 is a partial side sectional view of the movable supporting portion of the bag handle cutting apparatus.
Figure 3:
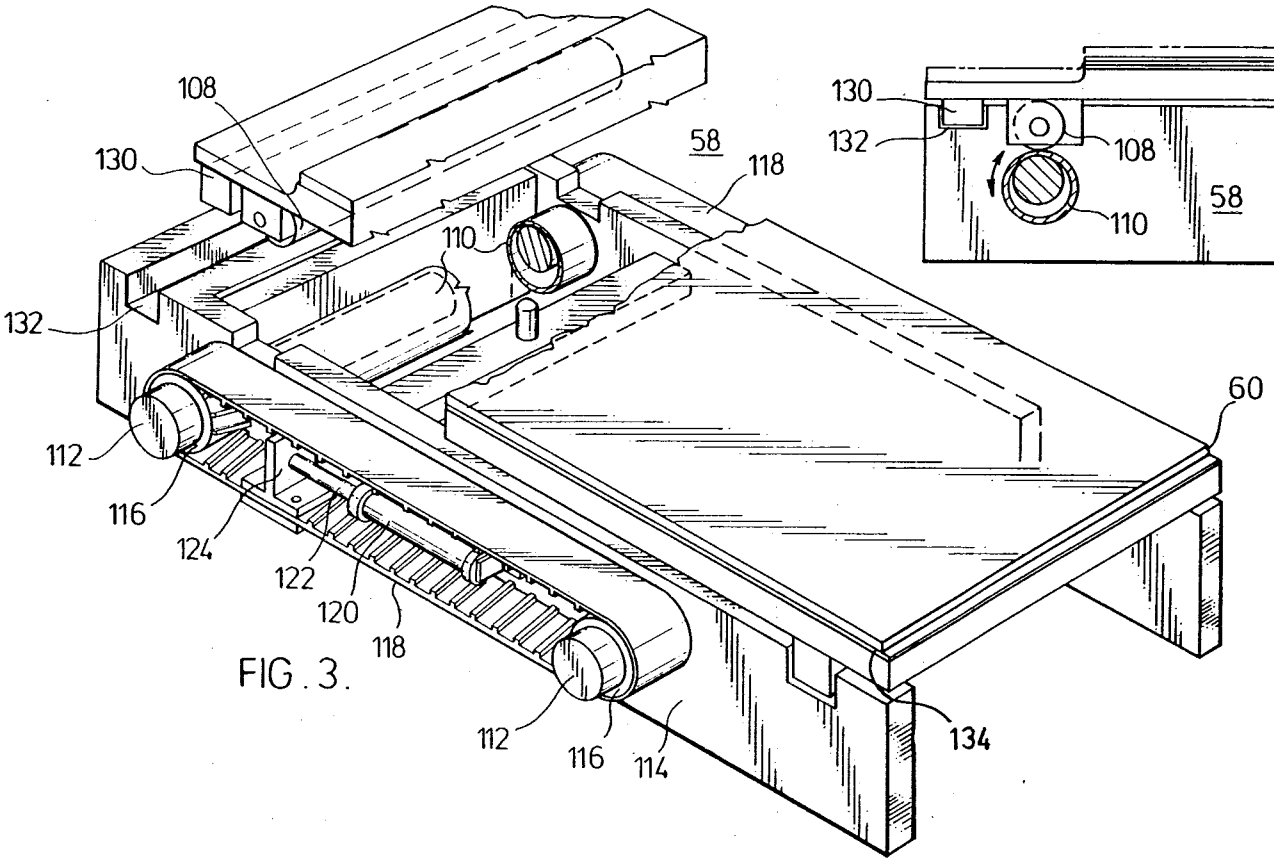
FIG. 3 is a three dimensional view of the movable supporting portion of the bag handle cutting apparatus.

Referring now to FIGS. 3 and 4 the lower support plate 60 is shown to comprise cam follower rollers 108. The two cam follower rollers 108 are provided adjacent each of the ends of the supporting side plates 114. Beneath each of the cam follower rollers 108 there is provided a cam or eccentric roller 110. At each of the ends of the plate 60 there is provided an axle 112 which passes through assembled side plates 114 so as to align and coordinate the rotation of the two cams 110. The axle 112 is journalled for rotation in the side plates 114 of the assembly and is provided with a timing belt pulley 116. The pulleys 116 on each side of plate 60 are surrounded by a respective timing belt 118. The timing belt 118 is moved by means of piston drive means 120. Piston drive means 120 comprises the reciprocal drive means of the present invention and is pneumatically operated. Two pistons 120 are provided on either side of the cutting means 58 so that both timing belts 118 are driven in unison and the axles 112 act to coordinate the force applied by cams 110 to the rollers 108. As the cams 110 rotate beneath rollers 108, the plate 68 is lifted uniformly upward towards the cutting means 90. The piston 120 has its piston rod 122 attached to bracket 124 which is in turn attached to the belt 118 by suitable means such as, for example, bolts. By having the cams 110 actuated by reciprocal movement of the pistons 120, the cams 110 do not have to travel a full 180° so that maximum travel of the plate 60 is not achieved. In fact, the apparatus is designed such that the stroke of pistons 120 is such that cams 110 rotate less than 180° and in particular, about 160°. As piston 120 is driven, it imparts motion to the coupling means which includes plates 124, belt 118, pulley 116 and cam 110. The pistons 120 are intermittently operable when the web material 14 is not being driven through the bag machine. The support plate 60 is thus movable between a first position separated from the cutting means 90 and a second position bringing the web material 14 into engagement with the cutting means 90. A return spring 126 and shank 128 are provided to assist the return of the plate to its position separated from the cutting means 90. Guide bars 130 of the support plate 60 are movable in grooves 132 of assembly 114 to maintain the position of the support plate. By providing a cam or cams 110, a lever action is provided such that the force exerted by the support means 60 towards the cutting means 90 varies, and in particular increases, while the force exerted by drive means remains constant. This results in an upward movement of the plate 60 which decreases in speed as the displacement towards the cutting means increases and which increases in force as the displacement increases. As a result the impact momentum of the plate is reduced while the cutting force is increased. Thus, the cutting means 90 does not have to compensate for movement of the plate 60 allowing the cutting means 90 to remain stationary.

It should be understood that a resilient material 134, such as rubber for example, is provided beneath plate 60 to absorb shock.

Referring to FIGS. 10 through 13 of the present invention, the circular cutting means of the present invention is shown. The circular cutting means of the present invention is provided for cutting the circular aperture 94 in the bag handles. The cutting apparatus includes a circular cutting blade 64 having a heater 98 provided therearound. The heater 98 is adapted to hold the blade in place on block 136. The cutting blade 64 cuts a circular aperture 94 from the web material which aperture 94 is of a first predetermined size. The cutting blade 64 of the cutting means or apparatus 138 are aligned above an aperture 140 in the movable support plate 60. The cutting means 138 further includes a plunger 142 of a predetermined size which is less than the size of aperture 140. Further, aperture 140 is less than the size of the cutting blade 64. As the plate 60 brings the web material 14 up into engagement with the cutting blade 64 a piercing means 144 mounted on a leading face 146 of plunger 142 pricks or pierces the plastic as shown in FIG. 11. As the plate 60 continues to move upwardly, the cutting blade 64 cuts through the web 14 forming a coupon 148. The piercing portion 144 maintains its positive hold on the coupon 148 and moves rapidly downward until the coupon is forced through the smaller dimensioned aperture 116 (see FIG. 13) by movement of plunger 142. At this time the plunger 142 is retracted and the coupon 148 will force itself from the piercing element or pin 144. The actuation of the plunger occurs approximately when the actuating member 150 is contacted by the lower support plate means 60. By including the piercing element or piercing means 144 on the leading face 146 of the plunger 142, the plastic web 14 is positively located relative to the cutting periphery or cutting blade 64. This ensures for a proper position cut of the plastic material and as the plunger 142 is driven into aperture 140, the coupon is pulled by the plunger relative to the piercing member 144 and will be pushed through the aperture 140. Without the use of piercing member 144, the coupon may still be attached at one portion to the plastic and not be forced completely through the aperture. As a result, when the web material is intermittently driven, the coupon may be brought with it. Accordingly, the circular cutting apparatus 138 of the present invention effectively ejects the coupon therefrom. As shown in FIG. 1, a chute 152 may be provided for collecting and directing the ejected coupons into a bin for collection.

Figure 9:
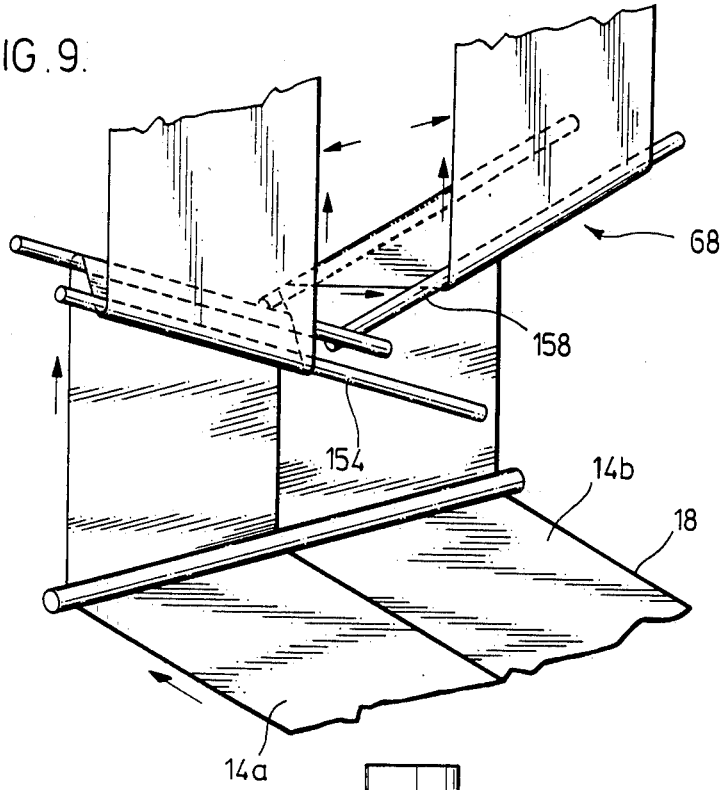
FIG. 9 is a schematic view showing the movement of the web over the separating apparatus.
Figure 10:
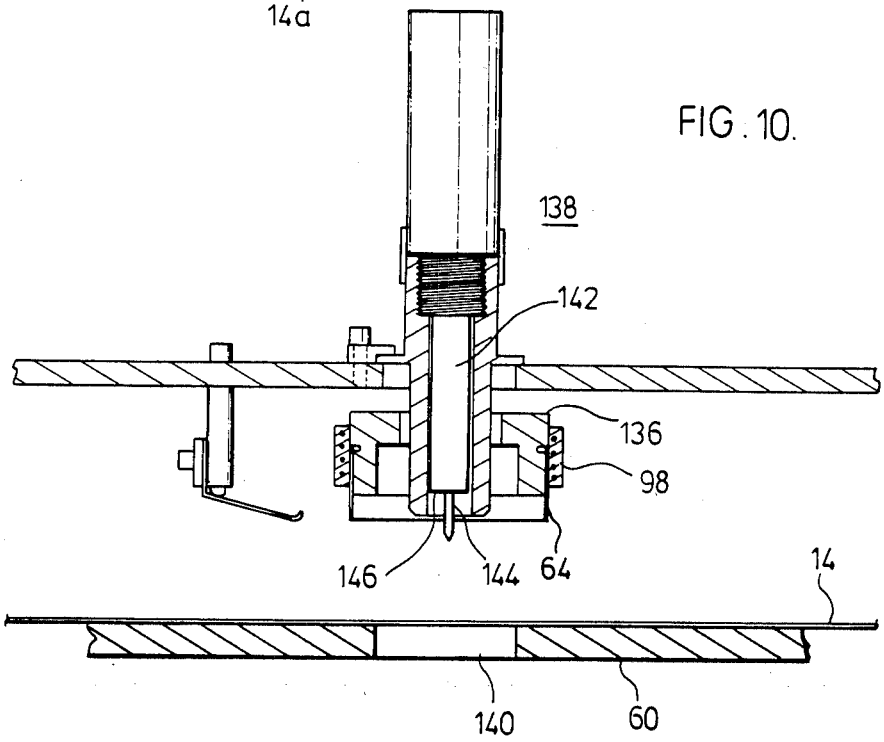

Referring to FIGS. 8 and 9, the separating apparatus in the present invention is shown. The separating apparatus 68 comprises a first pair of parallel rods 154 which are rigidly connected with side frame 156 and a second pair of parallel extending rods 158 which is rigidly connected to side frame 160. The rods 154 and 158 extend downwardly as shown in the drawings and extend at an angle inclined to the normal of the direction of elongation of the respective first and second web portions 14*a* and 14*b*. As web portion 14*a* rises, it passes over the rear rod of rods 154 and under the forward rod of rods 154. As web 14*a* passes over the rear rod of rods 154 it alters its direction of web travel to include a component which is transverse to the direction of elongation of the web portion 14*a* and away from the web portion 14*b*. As the web portion 14*b* passes over the forward rod of rods 154, it eliminates the transverse component therefrom. The other set of rods 158 are of similar design to rods 154 to effect a change in direction of web 14*b* as shown in the drawings. The rear rod and the forward rod of each of the pairs of rods 154 and 158 are designed such that the lower line defined by the forward rod is even with the upper line defined by the rear rod. The ends of the rods 154 are interconnected by interconnecting plates 162. Likewise the ends of rods 158 are connected by similar interconnecting rods which are not shown for the purpose of clarification. The rods 154 and 158 are positioned one above the other, overlap across the generally longitudinally extending line the web portions have been cut. As shown in the drawings, the separating apparatus 68 and the phasing above are on a vertical as opposed to the generally horizontal extending operations that the rest of the machine are performed. This saves floor space.

The embodiments of the invention in which an exclusive property or privilege is claimed are defined as follows:

1. In a bag making machine for producing bags from an elongate strip of plastic web material including means for cutting the web material along a wave-shaped line into first and second elongate web portions and including means to separate the web portions in a direction transverse to the direction of elongation of the web material, said separating means comprising:

a first pair of parallel rods inclined at a first angle normal to the direction of elongation of said first web portion, said first web portion travelling around a first rod of the first rod pair to alter its direction of web travel to include a component transverse to the direction of elongation of the first web portion and away from the second web portion, said first web portion travelling around the second rod of the first rod pair to again alter the direction of web travel by eliminating said transverse component from the direction of travel; and a second pair of parallel rods inclined at a second angle normal to the direction of elongation of said second web portion, said second web portion travelling around a first rod of the second rod pair to alter its direction of web travel to include a component transverse to the direction of elongation of the first web portion and away from the first web portion, said second web portion travelling around the second rod of the second rod pair to again alter the direction of web travel by eliminating said transverse component from the direction of travel, said first rod pair being offset horizontally and vertically from said second rod pair.

2. The machine of claim 1 wherein said first rod of each said rod pair lies below and forward said second rod, said first and second web portions travelling over said first rod and under said second rod of each respective rod pair; said rod pairs being connected at their ends.

3. The machine of claim 1 wherein said first and second web portions are travelling in generally vertical directions prior and subsequent to passing about said rod pairs.

4. The machine of claim 1 wherein said rods do not rotate.

5. The machine of claim 1 wherein two horizontal rollers are displaced vertically from one another one half bag width apart, said first and second web portions travelling over respective horizontal rollers subsequent to separation to be shifted in phase relative to each other.

* * * * *